United States Patent [19]

Strawson et al.

[11] 4,161,378

[45] Jul. 17, 1979

[54] PRODUCTION OF MOULDED COMPONENTS IN COMPACTABLE MATERIALS

[75] Inventors: Kenneth H. Strawson; Gerald Spencer, both of Sheffield, England

[73] Assignee: National Research Development Corporation, London, England

[21] Appl. No.: 911,156

[22] Filed: May 31, 1978

[30] Foreign Application Priority Data

Jun. 15, 1977 [GB] United Kingdom ..... 25136/77

[51] Int. Cl.[2] ..... B30B 9/28

[52] U.S. Cl. ..... 425/3; 425/84; 425/85; 425/574; 425/575

[58] Field of Search ..... 425/84, 85, 86, 3, 574, 425/575

[56] References Cited

U.S. PATENT DOCUMENTS

| | | | |
|---|---|---|---|
| 3,019,505 | 2/1962 | Van Den Berge et al. | 425/84 |
| 3,085,291 | 4/1963 | Haes et al. | 425/3 |
| 3,234,598 | 2/1966 | Quinn | 425/3 |
| 3,585,691 | 6/1971 | Wingblade et al. | 425/84 |
| 3,602,287 | 8/1971 | Eversdyk | 425/86 X |
| 3,804,576 | 4/1974 | Hehl | 425/575 X |
| 3,881,853 | 5/1975 | Loubier | 425/3 X |
| 3,989,581 | 11/1976 | Kober et al. | 425/84 X |

*Primary Examiner*—J. Howard Flint, Jr.

[57] ABSTRACT

A machine producing moulded components in a compactable material, the components being produced in die cavities in a die plate disposed between a filter assembly and a die cover plate, pressure of the compactable material in the die cavities causing filtration and compaction of the material. The compactable material may be a slurry material containing particles of magnetic material for the production of permanent magnet compacts, in which case means may be provided for producing an induced magnetic field around the die cavities before and during the compaction process.

13 Claims, 12 Drawing Figures

54
64
50
58
62
48
52
60
24
56
66
56
42
44
12
22
10
12
14
20
16
16
46
46
40
18

54
24
12
10
12
56

54
64
48
62
24
52
14
10
66
18

54
48
50
24
56
52
12
10
202
10'
10'
200
40
18
208
206
204
210
212
213

202
10
214
200

PRODUCTION OF MOULDED COMPONENTS IN COMPACTABLE MATERIALS

The invention relates to the production of moulded components in compactable materials and has for its object to provide an improvement therein. In particular, but not exclusively, the invention relates to the moulding of permanent magnet compacts in a compactable material containing ferrite particles, and the primary object of the invention is to provide such a machine by means of which such compacts of material can be produced at a very high rate of production and at relatively low unit cost.

According to the invention, there is provided a machine for the production of moulded components in a compactable material, the machine including a die plate having at least one cavity; a filter assembly adapted to form a closure member for said at least one cavity at one side of said die plate; a die cover plate adapted to be brought into engagement with the opposite side of said die plate; and means for ducting a compactable slurry material to said at least one cavity and for maintaining a slurry pressure such that liquid is expelled through the filter assembly to produce a compact of the material in a required condition in the or each cavity.

Figure 1:
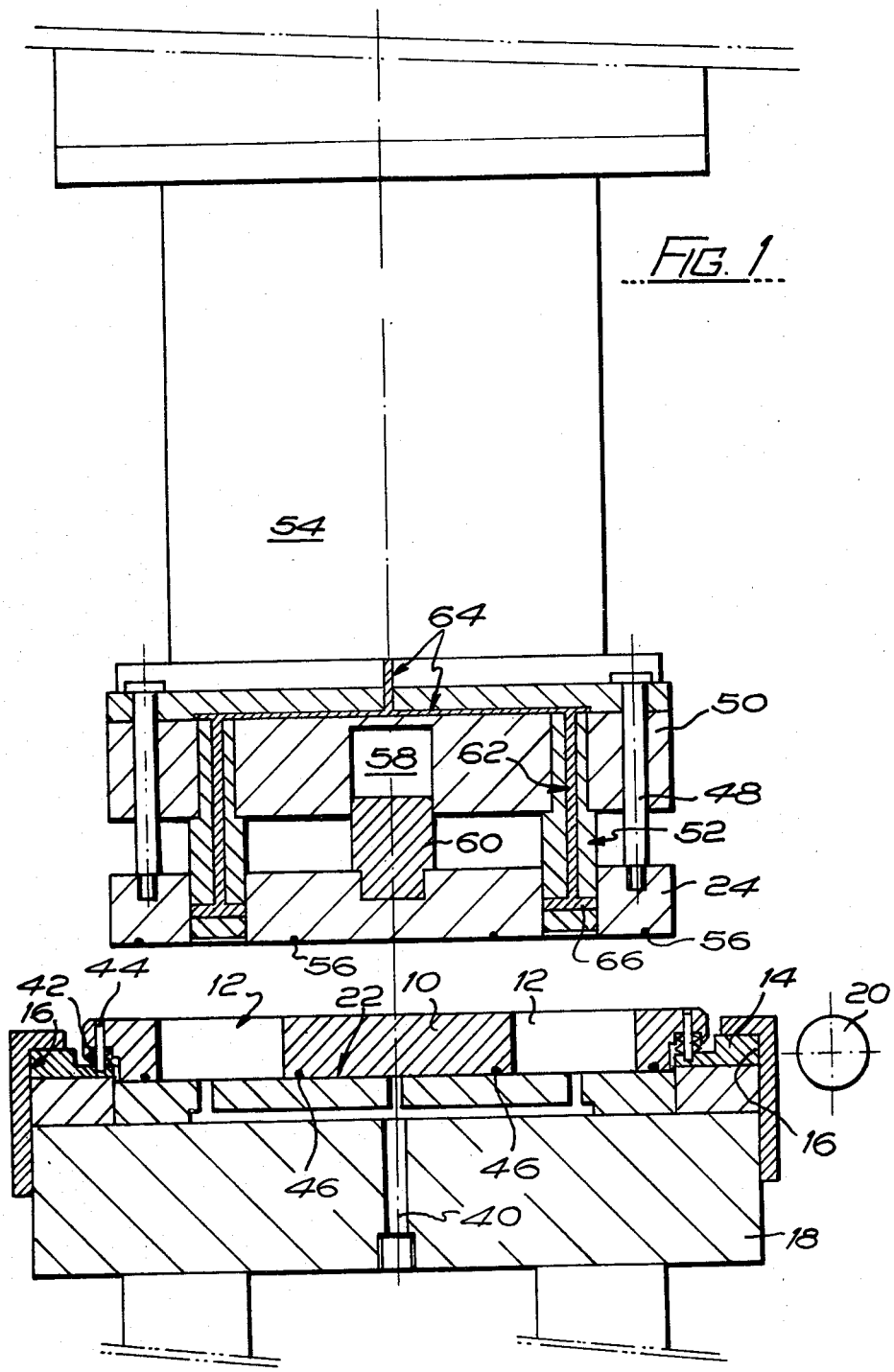
Figure 2:
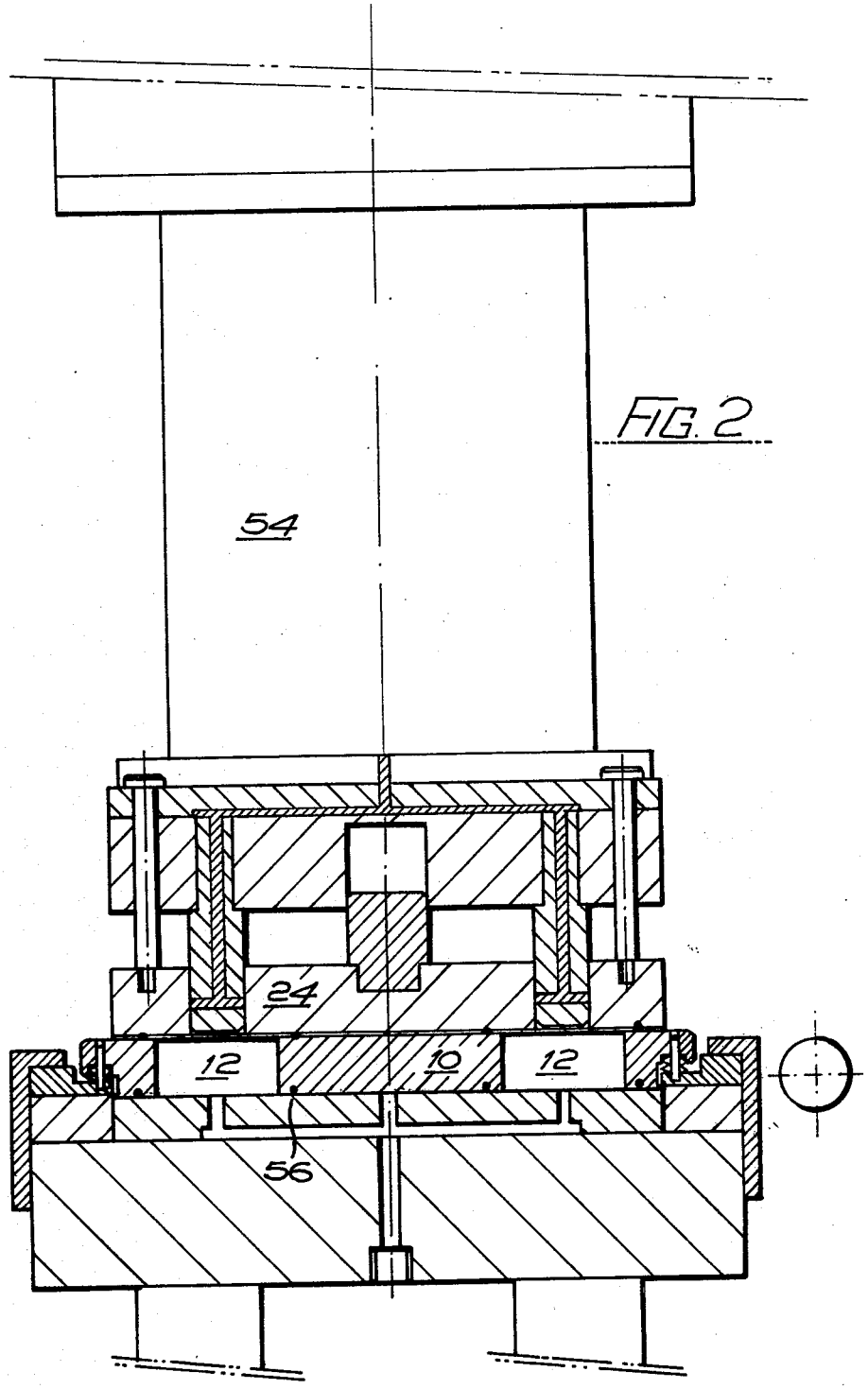
Figure 3:
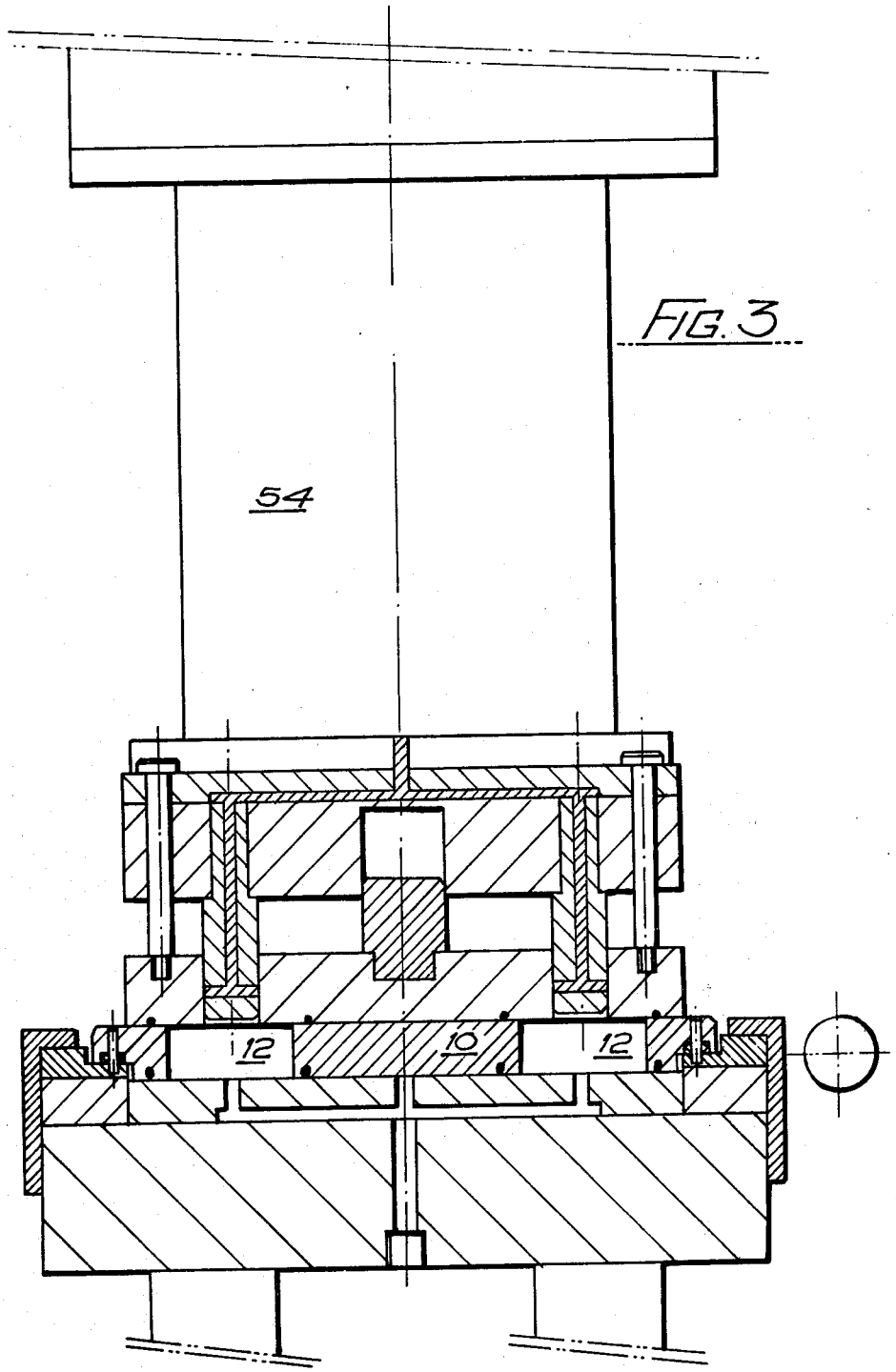
Figure 4:
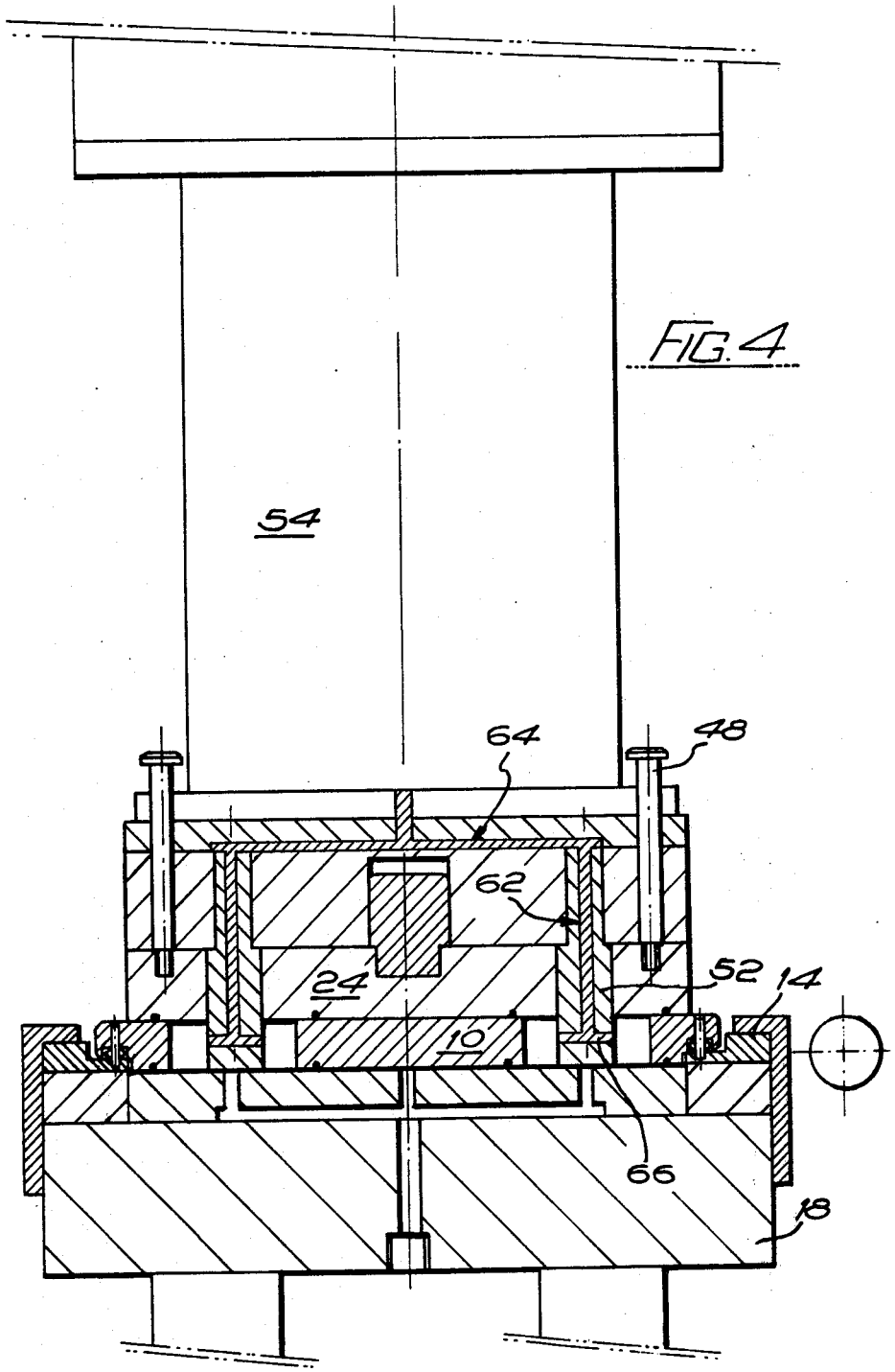
Figure 5:
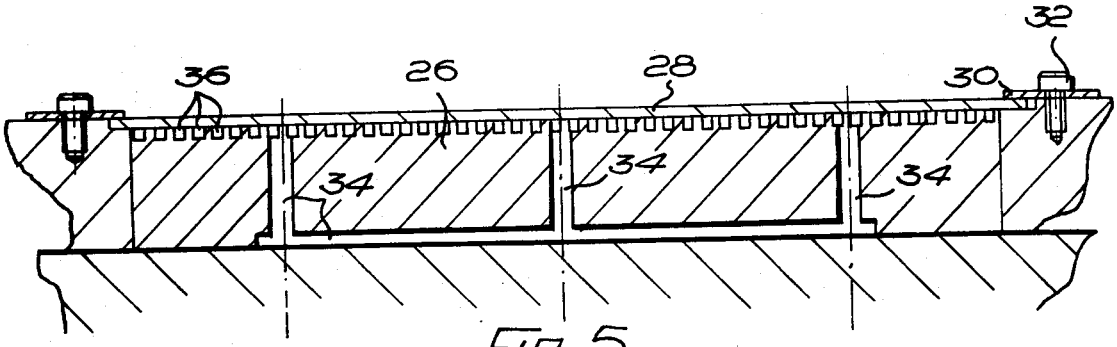
Figure 6:
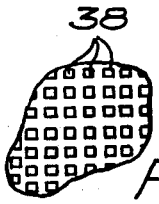
Figure 8:
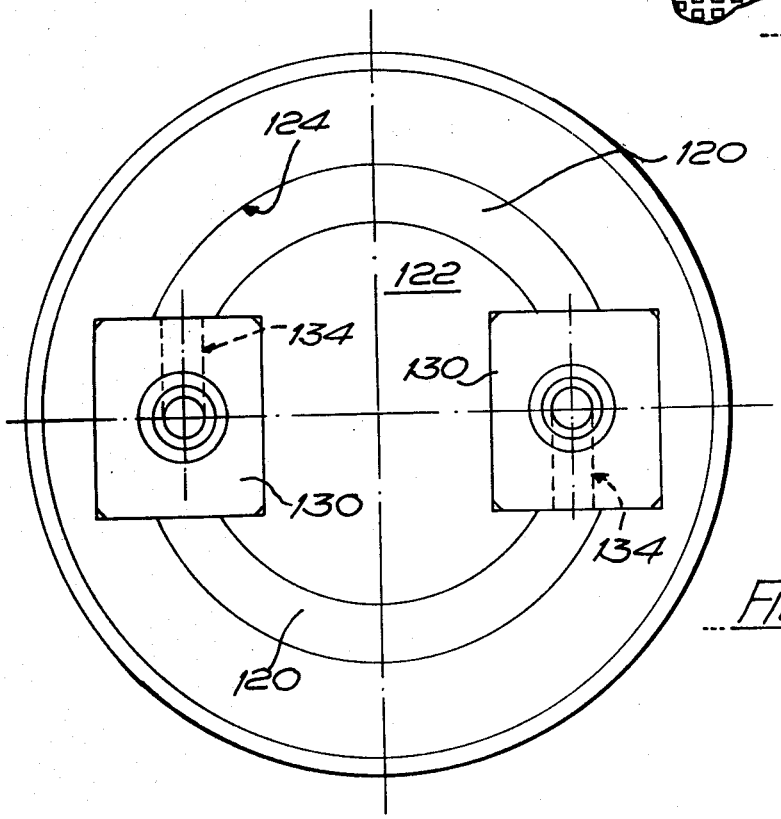
Figure 7:
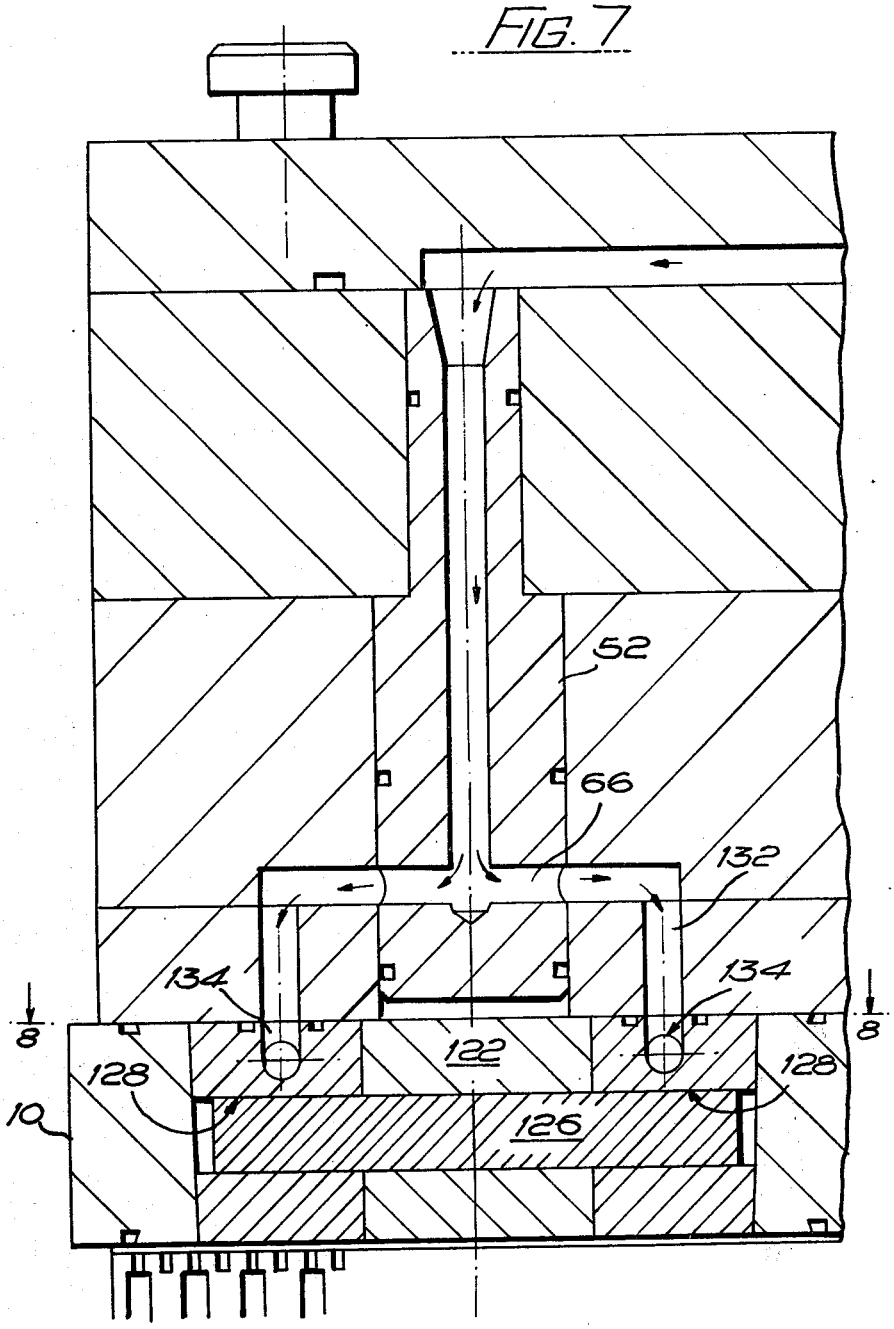
Figures 9, 10:
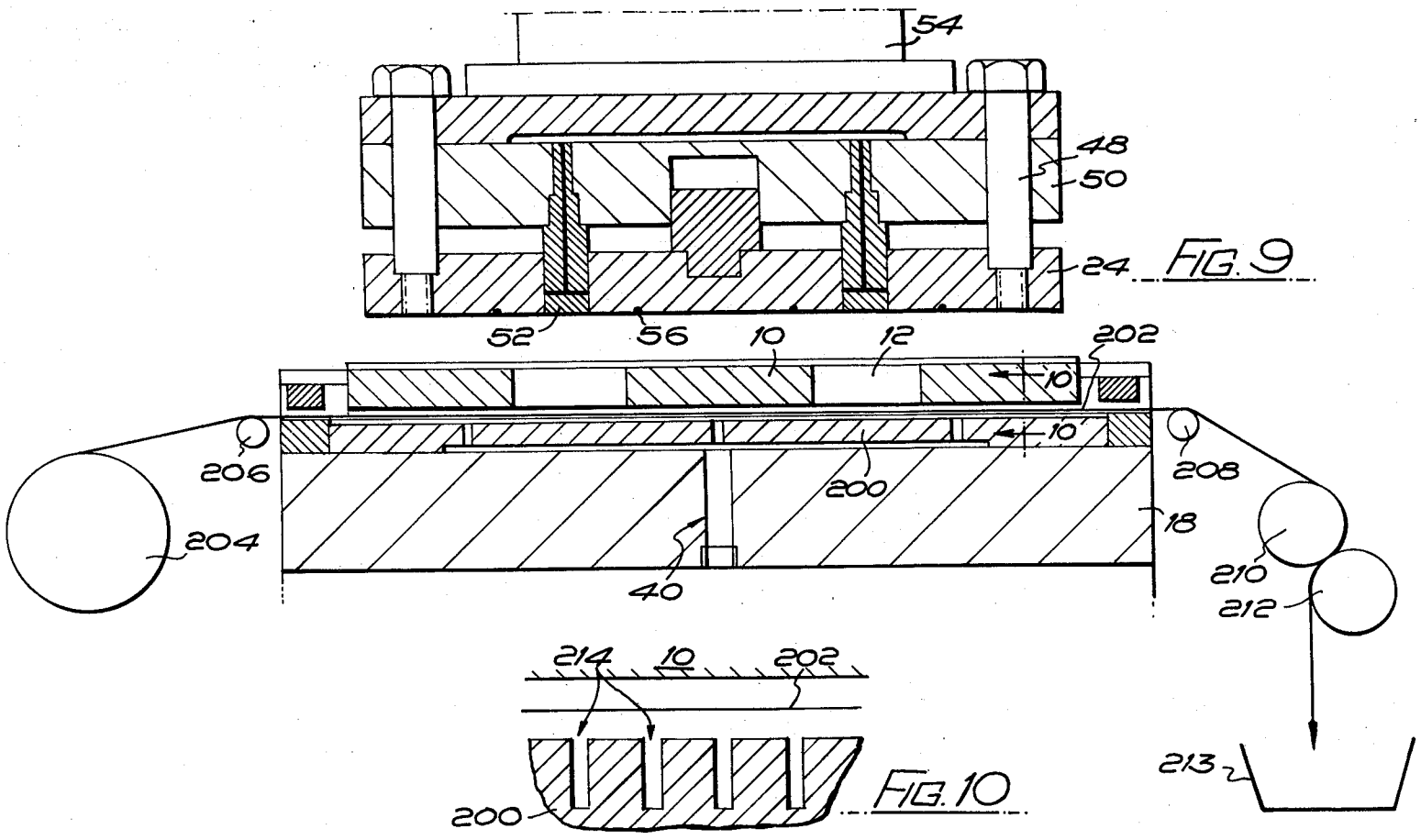
Figure 11:
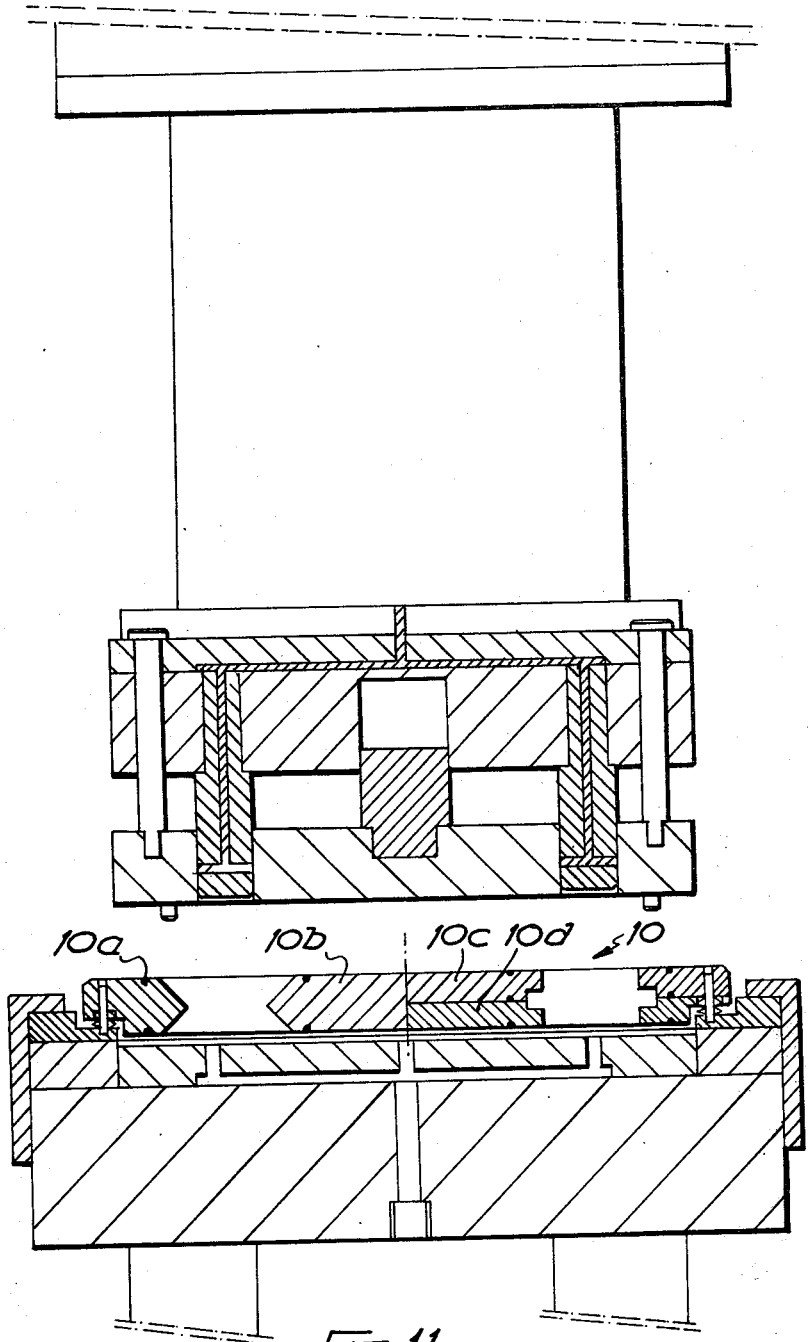
Figure 12:
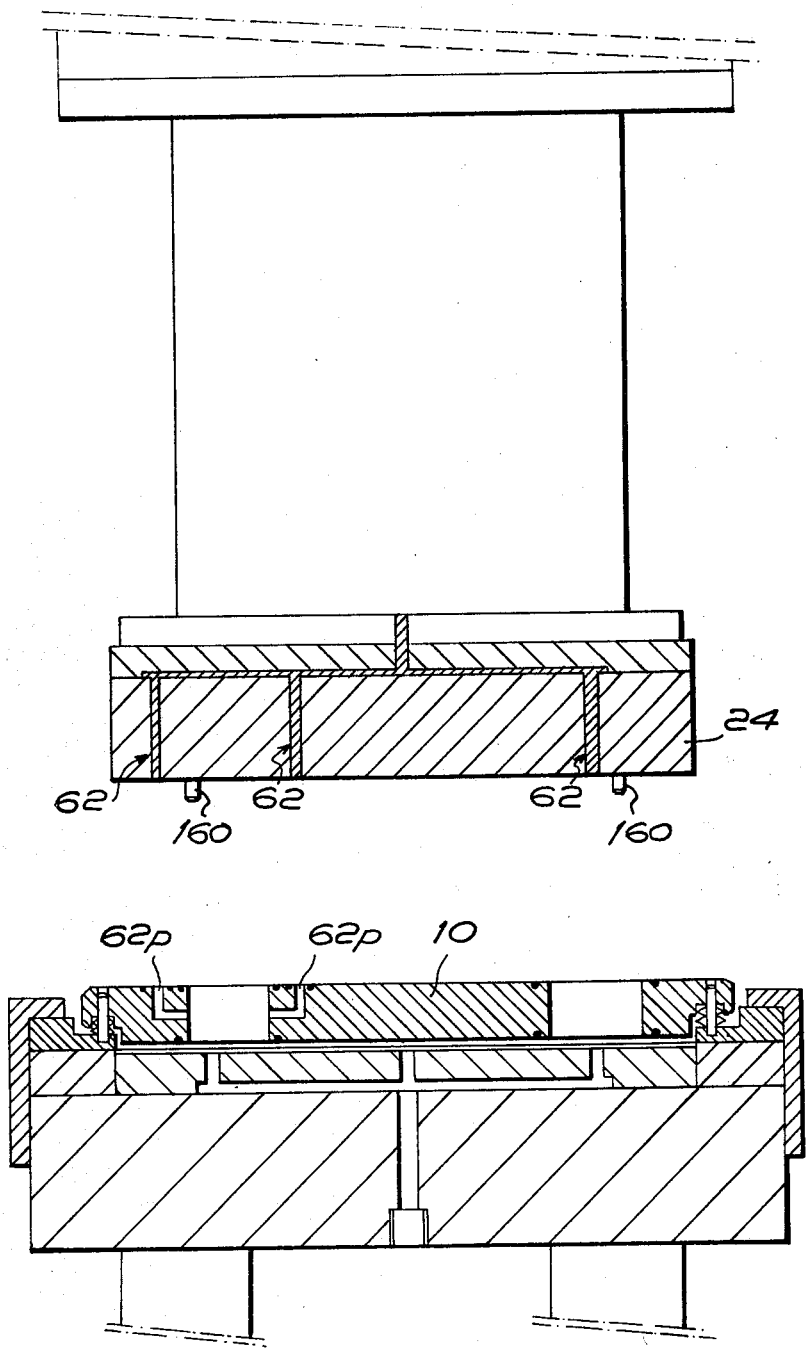

In order that the invention may be fully understood and readily carried into effect, the same will now be described, by way of example only, with reference to the accompanying drawings, of which:

FIG. 1 is a semi-diagrammatic drawing whih illustrates the construction of a machine embodying the invention for the production of permanent magnet compacts in a magnetic slurry material, the machine being shown in open condition, FIGS. 2 to 4 illustrate successive stages in the forming of a number of moulded components during the operation of the machine, FIG. 5 is a sectional scrap view of a so-called filter block assembly which will presently be referred to, FIG. 6 is a further scrap view of a part of the filter block assembly, FIG. 7 is a sectional view illustrating a modification which will presently be referred to, FIG. 8 is a sectional view on the line 8—8 in FIG. 7, FIG. 9 is a view similar to FIG. 1 which illustrates a further possible modification which will be referred to, FIG. 10 is a sectional view on the line 10—10 in FIG. 9 but drawn to a much larger scale than FIG. 9, and FIGS. 11 and 12 are views similar to FIG. 1 which will presently be referred to when describing further possible modifications.

Referring now to FIG. 1, the machine there illustrated includes a one piece die plate 10 which is provided with a number of cavities 12 (two such cavities being shown in the drawing) in which respective moulded components of annular form are to be produced. The die plate is mounted on a die plate carriage 14 which is slidably mounted in guides 16 on a fixed frame part 18 of the machine. A hydraulic ram, indicated schematically at 20, is provided for moving the die plate and die plate carriage to and from the position in which it is shown in the drawing, that is to say in which the die plate overlies a filter block assembly, generally indicated 22, and is located beneath a die cover plate 24. When the die plate has been moved from the position in which it is shown in the drawing, the moulded components which have been produced in the die cavities can be removed by means not shown.

Referring now in particular to FIGS. 5 and 6, the filter block assembly 22 includes a filter block 26 which generally corresponds in size and shape to the outline shape of the die plate. The filter block is mounted on the frame part and a filter pad 28 of rectangular outline shape overlies the filter block. The filter pad is held in place by a number of clamp elements 30 and screws 32. A series of closely spaced grooves 26 extend longitudinally and transversely across the top face of the filter block and communicate with fluid flow channels 34 of the filter. As shown in FIG. 6 the filter pad is thus supported on a plurality of discrete elements 38. A fluid flow passage 40 is shown in FIG. 1 to communicate with the fluid flow channels 34 and this may be connected to a vacuum pump (not shown) by means of which at a certain stage in the operation of the machine, liquid can be sucked from the grooves of the filter block for a purpose which will presently be explained.

It will be seen in FIG. 1 that the die plate, at the initial stage of operation of the machine, is suspended above the filter block assembly on stacks of Belleville spring washers 42 which are located on guide rods 44 upstanding from the die plate carriage. The die plate is located in position by, but slidable vertically on, the guide rods. The underside of the die plate is provided with resilient sealing elements 46 which surround the respective cavities 12, and when the die plate is downwardly displaced the sealing elements are pressed against the filter pad 28.

The die cover plate 24 is suspended on a plurality of headed guide pins 48 which extend slidably through a core plate/gallery plate assembly 50, and respective core rods 52 which are to extend into the cavities 12 of the die plate are connected to the core plate/gallery plate assembly and extend slidably through bores in the die cover plate. The core plate/gallery plate assembly is carried, for vertical movement, by a hydraulic ram assembly, generally indicated 54. Resilient sealing elements 56 are provided at the underside of the die cover plate and surround the bores through which the core rods extend, the arrangement being such that, as shown in FIG. 2, the sealing elements contact the top surface of the die plate when the hydraulic ram assembly is extended and the die cover plate is lowered onto the die plate, the upper end of the cavities 12 being sealed thereby. Further downward movement of the core plate/gallery plate assembly causes the die plate to be pressed downwardly against the filter block assembly as the Belleville spring washers are compressed (see FIG. 3) and a still further downward movement of the core plate/gallery plate assembly causes the core rods to extend through the die cover plate and to abut against the filter pad 28 as shown in FIG. 4.

Means are provided whereby the core plate and die cover plate can be urged apart to the maximum extent permitted by the guide pins 48, as shown in FIG. 1, said means being constituted by a centrally disposed cylinder 58 which is formed in the core plate and which accommodates a piston 60 in contact with the die cover plate, the arrangement being such that when a hydraulic pressure is ducted to said cylinder the die cover plate is urged downwardly with a controlled and constant pressure. Consequently, when the core plate is subsequently to be raised to its initial position it can be arranged that the core rods will retracted from the cavities 12 of the die plate before the die cover plate is raised. In this way, the moulded components which have been formed in the cavities 12 by the application of hydrostatic pressure to the slurry in the cavities to achieve a required density of the finished compacts, and which are still relatively fragile at this stage, are held together in the cavities until the core rods have been extracted.

Means which are provided for ducting a compactable slurry material to the cavities 12 of the die plate when the die has been closed include feed passages 62 which extend through the core rods from a common feed gallery 64 which has been formed at the core plate/gallery plate mating surfaces. The feed passages communicate with respective cross ports 66 near the ends of said core rods and the arrangement is such that when the core rods have been retracted into the die cover plate, as shown in FIG. 1, the ends of the cross ports are sealed, but when said rods have been extended through the cavities in the die plate as shown in FIG. 4 they open into said cavities for the supply of the slurry material thereto. A slurry pressure can be maintained in the die cavities for a predetermined period of time following their filling by the slurry material so that liquid is expelled through the filter assembly to produce compacts of material in the respective cavities in a required condition. (When the required condition of the compacts has been achieved, the material in at least the portions of the slurry feed passages nearest the cavities could be in that same compacted condition but this is of no importance because these plugs of material will be injected into the die cavities during the next moulding operation and will immediately form a homogeneous mass with the slurry material entering the cavities behind them).

Means (not shown) are provided for maintaining a magnetic field around the material in the die cavities as the slurry pressure is maintained and in this way the particles of magnetic material are correctly orientated in the slurry before and during the compacting process. Means (not shown) may also be provided to de-magnetise particles of material which have been correctly orientated in this manner.

The production of moulded components in a compactable material in the manner described above is advantageous in a number of respects. For example, it makes use of a substantially constant horsepower system in that at the commencement of die filling the available hydraulic power is absorbed in high slurry flow velocities but as the pressure of the slurry builds up within the die the rate of flow decreases and the available hydraulic horsepower is absorbed in generating high pressure. A further advantage is that the initial consistency of the slurry which is mixed for use in the machine is not critical and if a thinner consistency is used the constant horsepower feature referred to automatically compensates for this by increasing the initial slurry flow rate into the die so that total cycle time is maintained substantially constant. The fact that the compacts of material are produced in fixed capacity moulds results in the production of compacts which from each die cavity are virtually identical one to another in size, shape and volume. It will of course be understood that it is not essential for all the die cavities (nor indeed all the core rods) to be alike and indeed a set of different components may be produced during each moulding operation.

The apparatus is capable of very high rates of production and down time is reduced to a minimum by virtue of the fact that the filter pad 28 can very easily be replaced by the machine operator when it becomes clogged to such an extent that production rates are being affected.

Referring now to FIGS. 7 and 8, these illustrate an arrangement in which the moulded components have the form of curved segments, being formed in pairs of mould cavities 120 on opposite sides of respective fixed cores 122, the latter being suspended in position within cut-out apertures 124 in the die plate 10 by respective rods 126 which extend through the fixed cores and into aligned bores 128 in oppositely disposed inserts 130.

It will be observed that in this case the core rods 52 are not required to extend into the mould cavities but they are still retained in shortened form to constitute cavity feeders the cross ports 66 of which are put in communication with feeder ports 132 extending through the die cover plate when the latter has been brought into overlying engagement with the die plate. Passages 134 extend through the inserts 130 and distribute the slurry material to the mould cavities 120 when the die cover plate has been brought into overlying engagement with the die plate and the core plate/gallery plate assembly has been lowered relative to the die cover plate to bring the cross ports of the cavity feeders into communication with the feeder ports 132. It will also be observed that since the core rods in this case act only as cavity feeders, the free movement between the die cover plate and the core plate/gallery plate assembly has been greatly reduced. This free movement is required only to achieve the required cut-off of slurry feed before the die is opened.

Referring now to FIGS. 9 and 10, in a further modification the filter assembly previously described is shown to have been replaced by an assembly including only a filter block 200 and a pervious filter membrane 202 extending across the top of the filter block. The filter membrane is provided in the form of a roll 204 of flexible filter membrane material at one side of the die plate, an operative length of which is drawn off from the roll to extend over idler rollers 206 and 208 of barrelled form and to extend as shown between a driven roller 210 and a "pinch" roller 212. Used filter membrane material is shown to be falling into a collection bin 213 (but of course it will be understood that it could equally well have been arranged for used filter membrane material to be wound on a drum). The driven feed roller is driven intermittently by means not shown so that intermittent feed of the filter membrane material can be brought about during the operation of the machine, that is to say, for example, between successive moulding operations when the die cover plate is in raised condition as shown in the drawing. The idler rollers are positioned as shown so that the membrane material is guided through the gap between the die plate and the filter block, when such intermittent feed of the membrane material takes place, the efficient operation of the feed mechanism being unaffected by the fact that the diameter of the roll 204 is reduced as it becomes depleted. Means (not shown) are provided for impeding the free rotation of the roll 204, that is to say for applying a very small braking force to the roll, so that a required tension is maintained in the filter membrane, the arrangement being such that such means are self-compensating to allow for the gradual reduction in the inertia of the roll of membrane material as it becomes depleted. The means (not shown) for mounting the roll of membrane material are such as to facilitate its replacement when depleted.

Referring to FIG. 10, which is drawn to a very much enlarged scale, it will be seen that closely spaced grooves 214 which extend across the top face of the filter block (and which communicate with the fluid flow passage 40 shown in FIG. 9) are of very narrow width in relation to their depth so that the filter block is sufficiently flat and smooth to adequately support the filter membrane whilst facilitating adequate drainage of fluid passing through the filter membrane. (Such relatively deep and narrow and closely spaced grooves can be formed by spark erosion techniques). However, it will be understood that, if preferred, the filter block could have been provided with an overlying filter pad (the filter block and filter pad being substantially like those previously described and illustrated in FIGS. 5 and 6) the pervious filter membrane being arranged to overlie the filter pad.

The means (not shown ) by which the feed roller 210 are driven intermittently to bring about intermittent feed of the filter membrane material include a rack and pinnion drive mechanism (not shown) arranged to be actuated automatically by the moving of the die plate from its position between the filter assembly and the die cover plate to the position in which the or each compact produced in the die plate can be removed. (It could of course equally well have been arranged to be actuated in response to return movement of the die plate.) The drive mechanism is such that the rate at which the filter membrane material is fed from the roll is adjustable, and it will be understood that instead of or in addition to this, the frequency with which the operative length of membrane material is replace could be adjustable, that is to say so that instead of being replaced after each moulding operation it is replaced after a certain number of moulding operations have been carried out. Various other means could have been provided for bringing about intermittent feed of the filter membrane material. For example, a chain and sprocket drive could have been used or a direct coupled electric motor could have been arranged to stop and start by electrical control signals produced in response to such movements of the die plate. On the other hand, a D.C. torque motor drive system could have been arranged to run almost continuously (the closure of the die assembly causing the filter membrane to be trapped beneath the underside of the die plate so that the motor would at that time assume a temporarily stalled condition).

In FIG. 11, which is a view similar to FIG. 1 of a machine otherwise the same as that previously described, the die plate 10 is shown to be made in at least two separable parts so that after each moulding operation the said at least two parts can be separated to allow the release of at least one compact of material having a shape preventing its release from the assembled die plate (or from a one piece die plate). It will be understood that the drawing is diagrammatic and illustrates alternative methods by which the die plate can be made. The proposed construction on the left of the drawing comprises two parts 10*a* and 10*b* which abut together side by side along a parting face containing the axis of a cavity of rather complex shape, that is to say for producing a compact of annular shape with a circumferential V-groove. The proposed construction on the right of the drawing comprises two parts 10*c* and 10*d* which abut together one upon the other, the compact shape in this case being of annular form with a peripheral flange midway between its opposite ends. The manner in which the two parts of the die plate are to be secured together is not shown but it will be understood that this will be by way of quick release means operable by a machine operator when the die plate has been moved on the die plate carriage from the position in which it is shown in the drawing.

Referring now to FIG. 12, the machine there illustrated operates in substantially the same manner as that originally described, except that, since the compacts of material are not to be cored compacts the core rods and core plate have been omitted and the die cover plate 24 has been mounted directly on the gallery plate. Consequently, the feed passages 62 are now formed in the die cover plate and when the die is closed by the die cover plate descending upon the die plate the feed passages can either communicate with feeder ports 62*a* which are formed in the die plate as shown on the left of the drawing or can communicate directly with the or each die cavity as shown on the right of the drawing.

Various other modifications may be made without departing from the scope of the invention. For example, the die may be provided with any number of cavities from one upwards. The thickness of the die plate will of course also be varied to suit the depth of the moulded components required. Furthermore, if it is found that only a relatively small part of the filter pad will be used if it is made the same overall size and shape as the die plate, a reduced size filter pad may be used and the remainder of the area of the filter block will be covered by a flat impervious steel sheet to maintain the vacuum condition required. It will also be understood that the piston 60 slidable in the cylinder 58 could be replaced by a coil compression spring, although it is thought that a spring would not be quite so satisfactory because it would exert a variable force whereas a piston can exert a constant force dependent on the fluid pressure behind it.

The core rods may be shaped to produce internal diameters or indeed internal product configurations other than cylindrical. Furthermore, filter means may be provided in the die cover plate for example, such filter means being either additional to or instead of the filter assembly beneath the die plate. The materials of which the various parts of the machine are made will be selected with due regard to the fact that a magnetic field is to be maintained around the die cavities as the slurry is injected into them and/or during the compacting process, and also with due regard to the fact that the particles of material need to be demagnetised before the compacts are removed from the die plate. Resilient means other than Belleville spring washers may be provided for suspending the die plate above the filter block assembly at the initial stage of operation of the machine, for example coil springs or rubber blocks.

It will of course be understood that in a machine for the production of moulded components other than permanent magnet compacts the means referred to for maintaining a magnetic field around the material in the die cavities of the machine described above will not be required. On the other hand, where means are provided for maintaining a magnetic field around the material in the or each die cavity the die plate may be made of or have an inserted mass within it of a material having a high magnetic conductivity, the location of the mass of material, or the shape of the die plate, as the case may be, in relation to the or each die cavity being such that the induced magnetic field will be non-linear as it passes through the or each cavity and will conform substantially to a required non-linear magnetic field polarisation in magnet compacts which are to be produced.

Virtually any shape of compact can be produced by this machine, if necessary by the use of a die plate made in two or more separable parts. It will also be understood that in order to facilitate a change in production, that is to say from one product configuration to another, the shape of the or each cavity in the die plate (whether of otherwise one piece form or made in two or more separable parts) may be defined by one or more readily replaceable inserts in the die plate.

Means constituting a pressure intensifier may be associated with the hydraulic ram assembly 54 for feeding the compactable slurry material under pressure to the die cavities. On the other hand, such means could conceivably be constituted by electro magnetic means producing an induction effect within a slurry flow line.

What we claim and desire to secure by Letters Patent is:

1. In a machine for the production of moulded components in a compactable material, a die plate having at least one cavity; a filter assembly forming a closure member for said at least one cavity at one side of said die plate; a die cover plate adapted to be brought into engagement with the opposite side of said die plate; and means for ducting a compactable slurry material to said at least one cavity and for maintaining a slurry pressure such that liquid is expelled through the filter assembly for producing a compact of the material in a required condition in the at least one die cavity.

2. A machine according to claim 1, in which the die plate is a one-piece component and the at least one cavity is of such a shape that a compact of material produced therein can be ejected therefrom in the required condition.

3. A machine according to claim 1, in which the die plate is made in at least two separable parts so that after each moulding operation the said at least two parts can be separated to allow the release of at least one compact of material having a shape preventing its release from the assembled die plate.

4. A machine according to claim 1, including at least one core rod arranged to extend into a cavity in the die plate to form a cored compact of material.

5. A machine according to claim 4, in which the core rod is connected to a core plate from which the die cover plate is suspended on a plurality of headed guide pins, and in which means are provided whereby the core plate and die cover plate can be urged apart to the maximum extent permitted by the guide pins, the arrangement being such that, when a compact of material has been formed in the cavity in the die plate, the core rod is retracted before the die cover plate is raised whereby the fragile compact of material is held together until the core rod has been retracted.

6. A machine according to claim 4, in which the compactable slurry material is ducted through a feed passage which extends through the core rod and which communicates with a cross port near the end of said core rod, the arrangement being such that when the core rod has been retracted into the die plate cover the cross port is sealed but when the rod has been extended through the cavity in the die plate the cross port opens into said cavity for the supply of the slurry material thereto.

7. A machine according to claim 1, for the production of permanent magnet compacts, including means for maintaining a magnetic field around the material in the at least one die cavity as the slurry pressure is maintained so that particles of magnetic material of which the slurry is made are correctly orientated in the slurry before and during the compacting process.

8. A machine according to claim 1, in which guide means are provided for moving the die plate from the position between the filter assembly and die cover plate to a position in which the compact produced in the at least one cavity in the die plate can be removed.

9. A machine according to claim 8, in which the guide means are constituted by a die plate carriage on which the die plate is located by upstanding guide rods, resilient means being provided for urging the die plate upwardly relative to the die plate carriage such that at the initial stage of operation of the machine the die plate is suspended above the filter assembly but such that when the die cover plate is brought into engagement with the die plate the latter is downwardly displaced and pressed against the filter assembly.

10. A machine according to claim 1, in which the filter assembly, adapted to form a closure member at one side of the die plate, is constituted by a filter pad made of a pervious material and overlying a filter block having a series of closely spaced grooves extending across its top surface, said grooves communicating with fluid flow channels.

11. A machine according to claim 10, in which a pervious filter membrane overlies the filter pad and is provided in the form of a roll of flexible filter membrane material at one side of the die plate, means being provided at the other side of the die plate for bringing about intermittent feed of the filter membrane material across the surface of the filter pad during the operation of the machine so that a clean length of the material can be brought into position overlying the filter pad at appropriate intervals.

12. A machine according to claim 1, in which the filter assembly is constituted by a pervious filter membrane directly overlying a filter block, closely spaced grooves extending across the top face of the latter being of very narrow width in relation to their depth so that the filter block is sufficiently flat and smooth to adequately support the filter membrane whilst facilitating adequate drainage of fluid passing through said filter membrane.

13. A machine according to claim 12, in which the pervious filter membrane is provided in the form of a roll of flexible filter membrane material at one side of the die plate, means being provided at the other side of the die plate for bringing about intermittent feed of the filter membrane material during the operation of the machine so that a clean length of the material can be brought into position overlying the filter block at appropriate intervals.

* * * * *